United States Patent [19]

Erickson

[11] Patent Number: 4,464,191

[45] Date of Patent: Aug. 7, 1984

[54] CRYOGENIC GAS SEPARATION WITH LIQUID EXCHANGING COLUMNS

[76] Inventor: Donald C. Erickson, 1704 S. Harbor La., Annapolis, Md. 21401

[21] Appl. No.: 427,163

[22] Filed: Sep. 29, 1982

[51] Int. Cl.[3] ..... F25J 3/02

[52] U.S. Cl. ..... 62/31; 62/34; 62/39; 62/42

[58] Field of Search ..... 62/23, 24, 29, 31, 32–34, 62/38, 39, 42

[56] References Cited

U.S. PATENT DOCUMENTS 2,699,046 1/1955 Etienne ..... 62/29

*Primary Examiner*—Frank Seyer

[57] ABSTRACT

An arrangement of distillation columns is disclosed for subambient distillative separation of 2 mixture of non-condensable gases wherein two columns which exchange liquid achieve a given level of separation over a smaller temperature range than that required by a single column producing the same separation. The arrangement is useful for air separation to produce medium purity (90 to 99%) $O_2$ and/or $N_2$.

7 Claims, 1 Drawing Figure

CRYOGENIC GAS SEPARATION WITH LIQUID EXCHANGING COLUMNS

DESCRIPTION

1. Technical Field

This invention relates to processes and apparatus for the separation by subambient distillation of mixtures of non-condensable gases such as air.

The cryogenic distillation step incorporated in conventional air separation processes is characteristically inefficient due to the LP column pressure limitations, and also the composition of the liquids fed to the LP column. A more efficient distillation would provide any of a variety of benefits—lower the overall energy consumption, increase product and/or byproduct recovery and/or purity, or decrease size and cost of equipment.

2. Background Art

There is a practical limit shared by most dual pressure column type distillations, e.g., those used in air separation. The LP column top pressure ($N_2$ end) is set to enable the $N_2$ to spontaneously flow out of the cold box (e.g., through the reversing heat exchangers) and exhaust to atmosphere. Thus, the LP column overhead is usually in the range of 1.3 to 1.6 ATA, say for example 1.5 ATA. The column pressure drop (e.g., 0.2 ATA) then establishes a pressure of 1.7 ATA at the bottom ($O_2$ end), implying a boiling temperature of 95.7 K for the $O_2$. Assuming a typical 2 K $\Delta$ T across the reboiler/-reflux condenser heat exchanger, this requires the $N_2$ at the top of the HP column to condense at 97.7 K, i.e., at a pressure of 6.4 ATA. Hence, the supply air must be at a sufficient pressure, e.g., 6.8 ATA, to achieve the 6.4 ATA $N_2$ pressure in the HP column.

The energy consumption of a low pressure air separation process is essentially determined by the air compression requirement. Therefore, one way to reduce the energy required for air separation is to overcome the above practical limit, i.e., reconfigure the columns so that less than 6.4 ATA HP column overhead pressure is required.

The prior art discloses two means of doing this, but both entail disadvantages. U.S. Pat. No. 4,254,629 describes via a McCabe-Thiele diagram why the typical approximately 41% oxygen liquid feed to the low pressure portion of a conventional dual pressure column leads to inefficient operation. This is because that feed composition causes much of the column to operate very far from equilibrium. The patent further discloses that introducing at least part of the feed to the LP column as approximately 40% $O_2$ vapor vice liquid causes the lower column to operate much closer to equilibrium, i.e., more efficiently.

Two methods are disclosed for obtaining the approximately 40% $O_2$ vapor. Both entail use of an auxiliary column receiving supply air at a pressure somewhat below the pressure of the HP portion of the dual pressure column. In one approach, a reflux condenser refluxes the auxiliary column while gasifying approximately half the 41% liquid to 41% vapor. In the other case, a separate rectification column operating at a medium pressure refluxes the auxiliary column while generating both $N_2$ vapor and approximately 41% $O_2$ vapor.

The disadvantage of the above approach to saving energy by lowering the required supply pressure is that only part is lowered—approximately half or more of the air must still be supplied at the original high pressure.

The second approach disclosed in the prior art for lowering the practical limit on the pressure of the air supplied to a dual pressure column appears in French Pat. No. 2476816. In that disclosure, there are two reboiler/reflux condensers which connect the high pressure and low pressure columns, and they are located at different heights or tray locations (and therefore temperatures) in each. Thus, the 95.7 K boiling $O_2$ at the bottom of the LP column obtains heat from a midlength position of the HP column, where the temperature is 97.7 K but the composition still contains appreciable $O_2$. Higher in the HP column, where the composition approaches pure $N_2$, the temperature is lower and, hence, the pressure is lower than the previously cited 6.4 ATA. This location is refluxed by reboiling the LP column at an intermediate or midlength location.

This approach does allow all the supply air to be supplied at the lower pressure. However, it has two disadvantages—it limits the amount and purity of liquid $N_2$ obtainable from the HP column, which, in turn, adversely affects the reflux available to the LP column; and, it does not achieve any benefit from lower than usual LP column pressures.

The LP column pressure also affects air separation efficiency. Lower pressures yield a greater separation factor, requiring lesser reflux and reboil (and/or number of stages) for the same extent of separation. This effect is offset to some extent but not completely by the increase in enthalpy change of evaporation at lower pressures.

Another reference describing various energy efficient prior art approaches to separating nitrogen from air is U.S. Pat. No. 4,222,756. These approaches all share the practical limit described above, as modified by the liquid at the bottom of the LP column having substantially greater $N_2$ content e.g., up to 10%. (All percents are molar percents.)

DISCLOSURE OF INVENTION

The disadvantages of the prior art processes are avoided by providing a process (and/or apparatus) for separating a fluid mixture consisting essentially of oxygen and nitrogen and a supply of liquid nitrogen into a highly oxygen enriched fluid and gaseous nitrogen comprising:

(a) feeding the mixture to a first column and distilling it to gaseous nitrogen overhead and a further oxygen enriched liquid bottom product;

(b) refluxing the first column by direct injection of part of the liquid nitrogen supply;

(c) feeding the first column liquid bottom product to a second column, and distilling it to an oxygen depleted overhead liquid and a highly oxygen enriched fluid bottom product;

(d) refluxing the second column by indirect heat exchange with boiling supply liquid nitrogen;

(e) feeding the oxygen depleted overhead liquid from the second column to the first column, and distilling it also to gaseous overhead nitrogen and further oxygen enriched bottom product liquid.

In essence, this invention entails replacing the single low pressure column which accomplishes the entire desired separation at both ends with two shorter columns, each of which accomplishes the desired separation at only one end, and which has a composition at the non-specification end which falls within the composition range of the other column. One column operates at a somewhat lower pressure than the other, and each column exchanges fluid with the other by directing its non-specification product to the other. The lower pressure column produces specification bottom product, whereas its non-specification overhead liquid is pumped to the higher pressure column. The higher pressure column produces overhead product of desired or specified composition, and its nonspecification bottom fluid is transported to the lower pressure column. Each column operates over approximately the same temperature range, which is smaller than the temperature range of the original column which they replaced. The lower pressure column is refluxed via indirect heat exchange, whereas the other higher pressure column can be refluxed by direct injection of liquid overhead product.

When air is being separated by the above column arrangement, pressurized air which is cooled and cleaned to near its dewpoint would normally be supplied to a high pressure column, which is connected via reboiler/reflux condenser to both low pressure columns (the higher pressure and the lower pressure one). Thus, the HP column reboils both LP columns, and also provides both the liquid $N_2$ reflux for both columns and the oxygen enriched liquid for the higher pressure LP column. This arrangement is suitable for separating air into impure oxygen (up to about 98% purity, where argon is the major impurity); or alternatively for producing pure nitrogen in high yield, in which a waste gas of approximately 75% $O_2$ is also obtained.

BRIEF DESCRIPTION OF THE DRAWING

The single FIGURE is a simplified schematic flowsheet showing the disclosed distillation column arrangement as applied to an air separation process, showing only those components within the cold box necessary to illustrate the essential or preferred aspects of the invention.

BEST MODE FOR CARRYING OUT THE INVENTION

Figure 1:
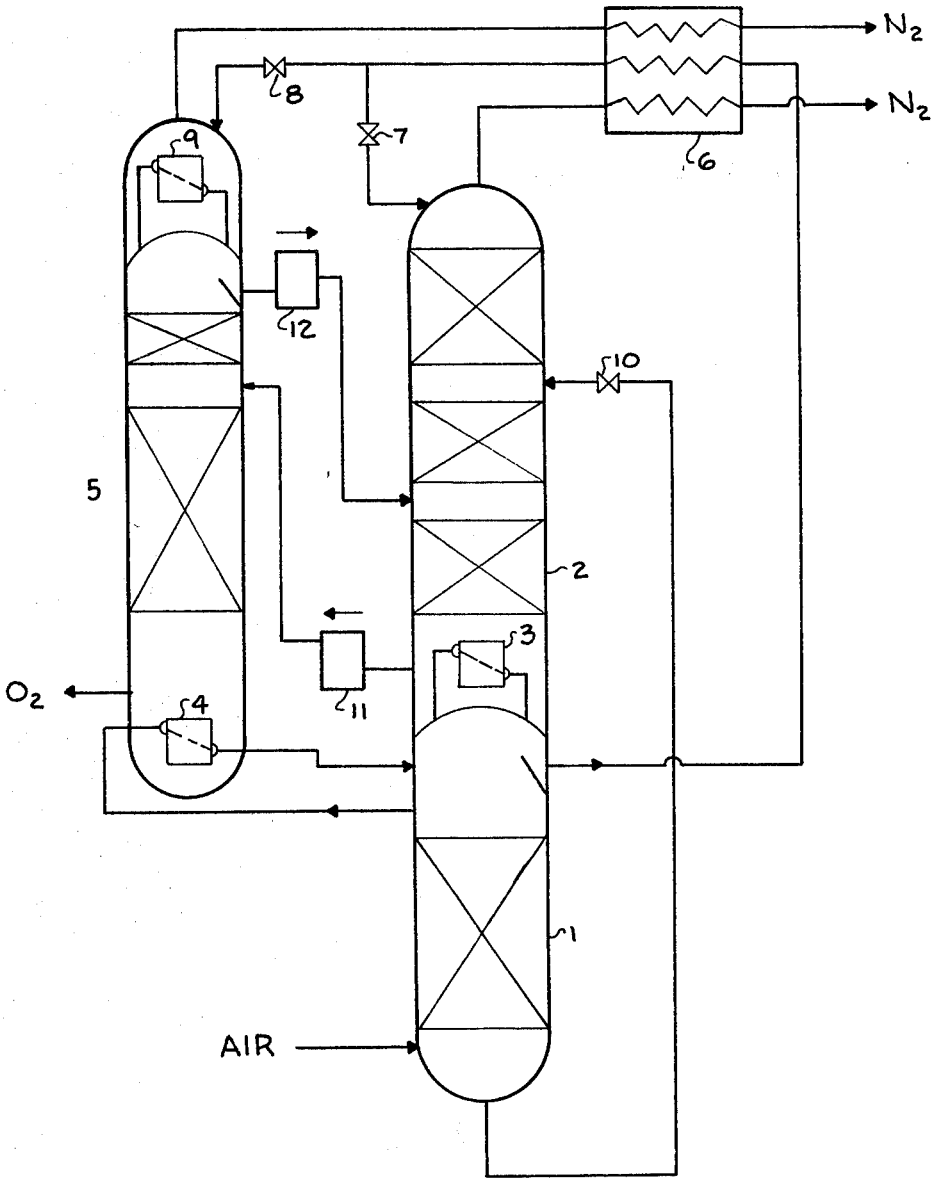

Referring to FIG. 1, a dual pressure column configuration consisting of high pressure (rectification) column 1 and low pressure distillation column 2 is shown, with the two columns connected via indirect heat exchange at reboiler/reflux condenser 3. Overhead from column 1 also provides heat to and is condensed by reboiler/reflux condenser 4, which reboils a second low pressure distillation column 5. Liquid $N_2$ from column 1 is routed via heat exchanger 6 and via means for pressure letdown (valves, orifices, hydraulic expanders, or the like) 7 and 8 to supply reflux to respective columns 2 and 5. Column 2 reflux is via direct injection, whereas column 5 reflux is via indirect heat exchange across reflux condenser 9. This allows column 5 to operate at a different (lower) pressure than the exhaust $N_2$ pressure, i.e., the column 2 overhead pressure. Air which has been compressed, cleaned, and cooled to near its dewpoint is introduced into column 1 and separated into liquid $N_2$ and oxygen enriched liquid. The latter is directed to column 2 via means for pressure letdown 10. In column 2 the oxygen enriched liquid is separated into further oxygen enriched bottom product and gaseous $N_2$ overhead. The bottom product is conveyed or directed or transported to column 5 via means for conveying 11, which may be a pump or a one-way valve or float valve or barometric leg or the like. In column 5 it is separated into highly oxygen enriched bottom product, which may be withdrawn as either gas or liquid, and oxygen depleted overhead liquid. The oxygen depleted overhead liquid is conveyed back to column 2 via means for conveyance 12. Nitrogen is withdrawn both from column 2 overhead and from column 5 reflux condenser 9, and oxygen is withdrawn from the bottom section of column 5.

The above arrangement can be used for producing medium purity oxygen of up to approximately 98% purity, with argon being the major impurity. In that application, and with a 1.5 ATA overhead pressure in column 2, the following suggested operating conditions would apply. Column 2 bottom pressure is approximately 1.7 ATA, temperature is 93.7 K, and liquid composition is 90%±6% $O_2$. Column 5 bottom temperature is also 93.7 K, but its pressure is 1.35 ATA and its liquid composition is 98.5%±1.5% $O_2$ approximately. The high pressure column 1 overhead is at 95.7 K, 5.6 ATA, and essentially pure $N_2$. Column 5 overhead is condensed by indirect heat exchange with boiling 1.5 ATA $N_2$ at 81 K, and, hence, is at 83 K, a pressure of 1.2 ATA, and a liquid composition of 50%±10% $O_2$. The column 5 overhead can be totally condensed and conveyed to column 2, i.e., it is not required that any reflux be returned to column 5, although it is not precluded. Thus, it can be seen that impure oxygen of approximately 98% purity is generated with an HP column overhead pressure of 5.6 ATA vice 6.4 ATA, and an attendant 0.8 ATA savings on supply air pressure. This savings represents approximately a 10% energy savings.

The FIG. 1 arrangement can also be used for producing nitrogen, with suitable modifications of the above operating conditions. Requiring once again that the column 2 overhead be at 1.5 ATA (and, hence, 81 K), the column 2 bottom can be at 1.65 ATA and 90.5 K, or approximately 78% $O_2$ liquid, and column 5 bottom can be at 90.5 K and 1.17 ATA, or approximately 5% $N_2$ (balance $O_2$ and Ar) liquid. The $O_2$ containing bottom gas is thus approximately 70 to 85% $O_2$. Column 5 overhead is at 1 ATA and 83 K, at a liquid composition of approximately 62% $O_2$. The HP column 1 overhead is $N_2$ at 92.5 K, which is a pressure of 4.3 ATA. Accordingly, it can be seen that this process produces pure $N_2$ at high yield from a supply pressure of less than 5 ATA.

All values and operating conditions above are only approximations, and actual values will usually vary somewhat. Still further variations will be apparent to the artisan, using the liquid exchanging column arrangement disclosed. The column 5 bottom product can be extracted as liquid, and part or all of column 5 can operate in the vacuum region. The $N_2$ delivery pressure (column 2 overhead) can be greater than 1.5 ATA, e.g., as high as 10 ATA, by appropriately increasing all remaining temperatures and pressures. The two gaseous $N_2$ withdrawal points needn't be at the same pressure or purity. As mentioned earlier, various conventional components are not illustrated, such as the refrigeration expander, hydrocarbon adsorber, reversing heat exchanger or equivalent, optional additional heat exchangers, etc. Also, the physical layout can be varied, e.g., columns 1 and 2 physically separated, or supplying 2 or more columns for the same duty, etc.

Finally it is emphasized that this liquid exchanging column arrangement is applicable to any noncondensable gas separation, not just air. For example it can be used to separate $N_2$—$CH_4$ mixtures, $CH_4$—$C_2H_6$ mixtures, $CF_4$—$CHF_3$ mixtures, $C_2H_4$—$C_2H_6$ mixtures, and even ternary mixtures (with appropriate addition of side columns).

I claim:

1. A subambient multi-component gas distillation process, comprising:

rectifying said multi-component gas to provide a substantially pure first component overhead liquid and a liquid bottom mixture enriched in a second component and a source of reboil;

providing a first and second low pressure column;

providing reboil to said first and second low pressure columns from said source;

feeding said liquid bottom mixture to said first LP columns;

feeding the bottom liquid from said first column to said second column;

providing reflux to said second LP column by indirect heat exchange with at least part of said substantially pure first component overhead liquid;

feeding the overhead from said second LP column to said first LP column;

withdrawing a substantially pure gaseous first component from the overhead of said LP column;

withdrawing a substantially pure fluid second component from the bottom of said second LP column.

2. The process according to claim 1 further comprising supplying cooled and cleaned air near its dewpoint to at least one high pressure column; reboiling the first and second columns by indirect heat exchange with the reflux portion of the HP column; and distilling the supply air to the liquid $N_2$ and the liquid mixture of $N_2$ and $O_2$ in the HP column.

3. The process according to claim 2 wherein the first and second columns are operated over approximately the same temperature range, within the range of 80 K to 100 K, and the first column operates at an average pressure at least 5% higher than the second column average pressure.

4. The process according to claim 3 wherein the second column bottom product is gaseous $O_2$ at a purity in the range of 90 to 99%.

5. The process according to claim 3 wherein the first column overhead nitrogen is the useful product and the second column bottom product is gaseous $O_2$ at a purity in the range of 70 to 85% $O_2$.

6. The apparatus according to claim 1 further comprising means to supply air which has been pressurized and cooled to near its dewpoint as the mixture, and wherein $N_2$ is the more volatile fraction.

7. In an apparatus, comprising elements designed, dimensioned and arranged for distilling multi-component gas mixture at subambient temperatures, including;

first means for generating reboil and rectifying the multi-component feed mixture to a substantially pure first component overhead liquid and a liquid bottom mixture enriched in a second component;

a first LP column;

a second LP column;

means for providing reboil to said first and second LP columns from said first means;

means for feeding said liquid bottom mixture from said first means to said first LP column;

means for feeding the liquid bottom product from said first LP column to said second LP column;

means for feeding the overhead of said second LP column to said first LP column;

means for refluxing the second LP column by indirect meat exchange with at least part of said first component liquid;

means for withdrawing a substantially pure first component stream from the top of said first LP column;

means for withdrawing a substantially pure second component stream from the bottom of said second LP column.

* * * * *